US009216312B2

(12) United States Patent
Richardson

(10) Patent No.: US 9,216,312 B2
(45) Date of Patent: Dec. 22, 2015

(54) ANTIGRAVITY SPINAL EXERCISER

(71) Applicant: Gravity Fitness Australia Pty Ltd, Auchenflower (AU)

(72) Inventor: Carolyn Anne Richardson, Warana (AU)

(73) Assignee: Gravity Fitness Australia Pty Ltd (AU)

( * ) Notice: Subject to any disclaimer, the term of this patent is extended or adjusted under 35 U.S.C. 154(b) by 123 days.

(21) Appl. No.: 14/191,982

(22) Filed: Feb. 27, 2014

(65) Prior Publication Data

US 2014/0296043 A1 Oct. 2, 2014

Related U.S. Application Data

(63) Continuation of application No. 12/849,809, filed on Aug. 3, 2010, now abandoned.

(51) Int. Cl.
*A63B 23/025* (2006.01)
*A63B 21/02* (2006.01)
(Continued)

(52) U.S. Cl.
CPC ..... *A63B 21/0552* (2013.01); *A63B 21/00043* (2013.01); *A63B 21/00185* (2013.01); *A63B 21/0442* (2013.01); *A63B 21/1407* (2013.01); *A63B 21/1469* (2013.01); *A63B 21/1484* (2013.01); *A63B 23/025* (2013.01); *A63B 21/0023* (2013.01); *A63B 21/068* (2013.01);
(Continued)

(58) Field of Classification Search
USPC ..... 482/10, 11, 43, 44, 49, 79, 91, 92, 482/121–126, 131, 139
See application file for complete search history.

(56) References Cited

U.S. PATENT DOCUMENTS 559,270 A 4/1896 Edwards
1,517,147 A 11/1924 Burnett
(Continued)

FOREIGN PATENT DOCUMENTS

DE 102005027776 A1 12/2006
EP 1733766 A1 12/2006
FR 2855762 8/2008
NL 1021716 A1 10/2002

OTHER PUBLICATIONS

Definition of contiguous, http://dictionary.reference.com/browse/contiguous, 5 pages total, last visited May 3, 2012.

*Primary Examiner* — Oren Ginsberg
(74) *Attorney, Agent, or Firm* — Mark D. Miller

(57) ABSTRACT

The invention provides an exerciser for use in activating deep posture and antigravity muscles in the body. The exerciser (1) comprises a headpiece (2) having at least: a first member (6) which fits around the head of a wearer in a transverse plane above the ears when the headpiece is in situ; and, a second member (7), the ends of which are fixed to the first member and which crosses the head of the wearer (5) at about the coronal plane thereof when the headpiece is in situ. The exerciser further comprises at least one flexible strap (3) on each side of the headpiece which is attached at or near the end of the second member and has at least one portion within its length that is elastic; and, an adaptation (4) at the free end of each the flexible straps to permit extension of the strap by a limb of the wearer (5). Each strap of the exerciser has a length and elasticity which allow a smooth, low velocity movement by the wearer (5) at least involving axial movement of the limb away from the head. The invention also provides methods of using the exerciser.

14 Claims, 10 Drawing Sheets

(51) Int. Cl.

| | |
|---|---|
| ***A63B 21/055*** | (2006.01) |
| ***A63B 21/00*** | (2006.01) |
| ***A63B 21/04*** | (2006.01) |
| *A63B 21/002* | (2006.01) |
| *A63B 21/06* | (2006.01) |
| *A63B 21/068* | (2006.01) |
| *A63B 22/00* | (2006.01) |
| *A63B 22/20* | (2006.01) |
| *A63B 23/04* | (2006.01) |
| *A63B 23/12* | (2006.01) |

(52) U.S. Cl.

CPC ..... *A63B 21/0611* (2013.01); *A63B 21/1434* (2013.01); *A63B 22/0089* (2013.01); *A63B 22/205* (2013.01); *A63B 23/0405* (2013.01); *A63B 23/1281* (2013.01); *A63B 2230/62* (2013.01)

(56) References Cited

U.S. PATENT DOCUMENTS

| | | | | |
|---|---|---|---|---|
| 1,543,346 | A | 6/1925 | Titus | |
| 4,832,333 | A | 5/1989 | Lockett | |
| 5,318,494 | A | 6/1994 | Santighian | |
| 5,336,139 | A | 8/1994 | Miller | |
| 5,498,218 | A | 3/1996 | Proctor et al. | |
| 5,505,677 | A | 4/1996 | Hinds | |
| 5,643,159 | A | 7/1997 | Ivarone | |
| 5,662,554 | A | 9/1997 | Schaefer | |
| 7,722,301 | B2 | 5/2010 | Rosenblum | |
| 8,613,690 | B1 * | 12/2013 | Thompson | 482/10 |
| 2004/0058780 | A1 | 3/2004 | Edgeton | |
| 2005/0043154 | A1 | 2/2005 | Atrizadeh | |
| 2007/0042869 | A1 | 2/2007 | Pettibon | |

* cited by examiner

ANTIGRAVITY SPINAL EXERCISER

PRIORITY CLAIM

This is a continuation of U.S. Utility patent application Ser. No. 12/849,809 filed on Aug. 3, 2010 which is incorporated herein in its entirety by this reference.

TECHNICAL FIELD

The invention described herein relates generally to muscle condition and posture. In particular, the invention is directed to an exerciser for use in activating deep posture and antigravity muscles in the body, although the scope of the invention is not necessarily limited thereto.

BACKGROUND ART

Weightbearing exercise by itself is insufficient for healthy muscles and bones. Good posture during weight-bearing exercise is essential to activate the deep posture and antigravity muscles and to protect the joints of the body from injury. To counteract the effects of gravity during weightbearing exercise or weightbearing function, good posture and postural cues need to be in operation to activate deep posture and antigravity muscles.

The most important postural cues are: stretching tall (through the crown of the head) with the object of lengthening the spine while lowering the shoulders and shoulder blade; and, drawing in the naval towards the spine without changing spinal position. It is not always easy to intentionally induce these cues. In view of the cost to society of back injuries and bone disorders, and the inconvenience to a large proportion of the population of back discomfort, good bone and muscle health is highly desirable.

In view of the emphasis on—and need for—good bone and muscle health, there is a need for ways of activating deep posture and antigravity muscles as a preliminary to or during weightbearing exercise or weightbearing function. However, there is no widely available technique or exerciser that meets this need.

The availability of such a postural exercise device would also be useful for the diagnostic application of musculoskeletal disorders in Magnetic Resonance Imaging (MRI) and for gravity simulation in Space. However, in the latter use the postural exercise device would not need to replicate the Gravity Simulation Suit used by Russian astronauts, but merely be a specific neck, and upper and lower body exerciser for enhancing neuro-muscular control.

It is an aim of the invention to provide an exerciser and method of using the same which meets the foregoing needs.

SUMMARY OF THE INVENTION

In a first embodiment, the invention provides an exerciser comprising:

a headpiece having at least:

a first member which fits around the head of a wearer in a transverse plane above the ears when said headpiece is in situ; and a second member which is fixed to said first member at or near the ends of said second member and which crosses the head of said wearer at about the coronal plane thereof when said headpiece is in situ;

at least one flexible strap on each side of said headpiece which is attached at or near the end of said second member and has at least one portion within its length that is elastic; and an adaptation at the free end of each said flexible strap to permit extension of the strap by a limb of said wearer;

wherein, each said strap has a length and elasticity which allow a smooth, low velocity movement by said wearer at least involving axial movement of said limb away from the head.

In a second embodiment, the invention provides a method of training neuromuscular control of a chain of muscles involved in holding good posture, through the activation of deep posture and antigravity muscles, the method comprising the steps of:

(a) fitting a headpiece of an exerciser according to the first embodiment;

(b) applying a limb to the adaptation at the end of a strap of said exerciser;

(c) extending each strap by limb movement associated with compression and holding of the scapula, with the hip joint and shoulder joint in axial alignment with the ear in the coronal plane;

(d) holding each strap extended for at least five seconds;

(e) relaxing the limbs and shoulders to allow each strap to retract; and (f) repeating steps (c) to (e) until said deep posture and antigravity muscles are sufficiently activated.

In the following description and claim, the term "user" is used interchangeably with "wearer".

With regard to the first embodiment as defined above, it will be appreciated by one of skill in the art that the second member of the headpiece provides a vertical force (when the wearer is standing) on the top of the head as a consequence of the extension of the straps. By virtue of the attachment of the second member to the first member, that force is focused over the crown of the head providing an axial compression force. This simulates gravity and activates the deep posture and antigravity muscles of the body.

At a minimum, the headpiece comprises the two members described above. While these members must be flexible so that the headpiece can be worn by a wearer of the exerciser, they must be relatively inextensible so that the headpiece remains in the correct position during use of the exerciser and so that force is transmitted as desired to the crown of the head. The components of the headpiece can be sized to suit the head of a user of the exerciser. Alternatively, members can be length-adjustable so that a headpiece comprising members of particular lengths can be used with heads of different dimensions. The first member of the headpiece can advantageously have length-adjustment devices at both the front and/or rear of the headpiece. This allows the size of the headpiece to be adjusted without the second member moving from the coronal plane position when the headpiece is in situ. In instances where it is desirable to have only one length-adjustment device in the first member, the position at which one of the ends of the second member is attached to the first member must also be adjustable.

Rather than comprising two members, the headpiece can also take the form of a cap, hat or any other type of headwear. The only requirement of such alternative headpieces is that they stably locate the straps so that there is the desired transfer of force over the crown of the head.

The flexible straps of the exerciser can be any suitable material such as a rubberized strip of material. In such instances, the elastic portion of a strap comprises essentially the entire length of the strap. However, non-elastic portions can be provided at each end of the strap for attachment to the first member of the headpiece and for connecting to the adaptation at the end of a strap. Each strap can alternatively comprise at least one metal coil spring, such as those commonly used in exercise devices. The flexible straps can also comprise a plurality of strips of elastic material or coil springs.

In a preferred form of the exerciser, the elasticity of each strap can be varied. This can be achieved by including in the strap a coil spring which has a variable spring constant. The variable elasticity of a strap can also be achieved by varying the number of coil springs in a strap when the strap comprises a plurality of coil springs. A strap that comprises a plurality of strips of elastic material can be utilized to adjust the resistance against stretching by increasing or reducing the number of individual strips of elastic material.

Each strap of the exerciser is advantageously length-adjustable.

When used in conjunction with MRI, metal must be excluded from the exerciser.

In some forms of the invention, each strap of the exerciser and the second member of the headpiece can be a continuous strip of material. However, in such forms of the exerciser, a second strip of inextensible material must be combined with the portion of the strip comprising the second member so that member as a whole is inextensible.

The adaptation at the free end of each flexible strap is configured to suit the limb—arm or leg—intended to be used for the extension of the strap. In a simplest form, the adaptation can merely comprise a loop at the free end of the strap. The loop advantageously has a layer of an inextensible material on at least the inner surface of the loop to provide a more comfortably surface for gripping by the hand of the wearer of the device or for applying pressure by way of the foot.

In instances where the exerciser is configured for extension of the straps by the arms of a wearer, the adaptations at the ends of the straps can be hand grips. Such hand grips can be any of the types of hand grips used in exercisers. Typically, these hand grips comprise a longitudinal member fixed between the ends of a curved member to which the strap is attached. The longitudinal member can be shaped for more comfortable gripping of the same.

Extension of the strap by the arm of the user can be by application of pressure by way of the hand or the elbow. In the latter instance, the adaptation of the end of the strap is typically a loop. However, the adaptation can also be a cup or socket into which the elbow is fitted for extension of the strap. A cup or socket can also be the adaptation for the application of pressure by way of the foot.

The fixing of the second member to the first member of the headpiece can be by any suitable method including a hook and loop fastener, sewing, riveting or bonding. The straps can similarly be attached to the headpiece by a hook and loop fastener, sewing, riveting or bonding. The straps can also be attached to the headpiece by passing the straps through loops positioned at the ends of the second member. Preferably however, the flexible straps are attached by way of a clip or buckle so that they are detachable.

An exerciser of the invention can include two sets of flexible straps, one set being for action upon by the arms of the user and the second set for action upon by the legs of the user.

In a preferred embodiment and to ensure correct postural alignment (between the ear, shoulder and hip joint), the flexible straps can be configured so that they pass around the shoulders of the user when the exerciser is in situ. This can be achieved by dividing the strap in the region adjacent the shoulder. An arm of the user is passed through the gap formed by the divisions of the strap. Each flexible strap can alternatively be duplicated so that when is in situ, a strap passes from the headpiece over the front and back of the shoulder of the user to rejoin at the adaptation at the free ends of the two straps.

The foregoing features of the preferred embodiment of the exerciser will be described in greater detail below.

The components of the exerciser not specifically described above can be in accordance with the same or similar components used in the art and related arts.

With regard to the second embodiment of the invention, the stretching is advantageously done gently rather than in a jerky or sudden manner and is away from the user's head and shoulders (preferably straight down towards the heels of the feet). At the same time the user extends the head—and lowers the shoulders—to achieve the deep posture and antigravity muscle activation. With an exerciser that has straps adapted for use with arms as the limbs through which pressure is applied, the arms are advantageously held relatively close to the sides of the body during the stretching of the straps to ensure an axial force is produced at the crown of the head via the headpiece. Similarly, when legs are used for strap stretching, the legs are extended while being held relatively close to the sagittal plane of the user.

With regard to step (d) of the second embodiment method, the time that the strap is held extended can be up until the user begins to feel fatigue. This will typically be of the order of one minute but will vary with the physical condition of the user.

The exerciser can be used in a simulated weight-bearing situation in any position but most often in an upright sitting position or while supine, in an upright standing position, or standing while leaning forward from the hips. For some users, it can be useful to use the exerciser while exercising the lower limbs (for example, while walking). The simulated weight-bearing situation can also be attained using equipment generally referred to as a "home gym". Such use will be explained in greater detail below.

As indicated above in the definition of the first embodiment of the invention, the applied resistance for an exercise session—for adults as well as younger individuals, whose maximal neck force would be half that of the adult—is designated as "enough resistance to allow a smooth, low velocity movement involving shoulder blade depression (i.e., shoulders move in a downward direction).

The exerciser according to the invention is advantageously used in conjunction with the article described in the international application entitled "Posture Indicator" (International Publication Number WO 2007/134380), the entire content of which is incorporated herein by cross-reference.

In order that the invention may be more readily understood and put into practice, one or more preferred embodiments thereof will now be described, by way of example only, with reference to the accompanying drawings.

DETAILED DESCRIPTION OF PREFERRED EMBODIMENTS

In FIGS. 1 to 10 and 12, a filled arrow represents the direction of the extension force from a limb acting on a flexible strap of the exerciser, while an open arrow refers to the force which counters the extension force. The open arrow therefore represents an attempted lengthening of the spine to attain good postural form.

Figure 1:
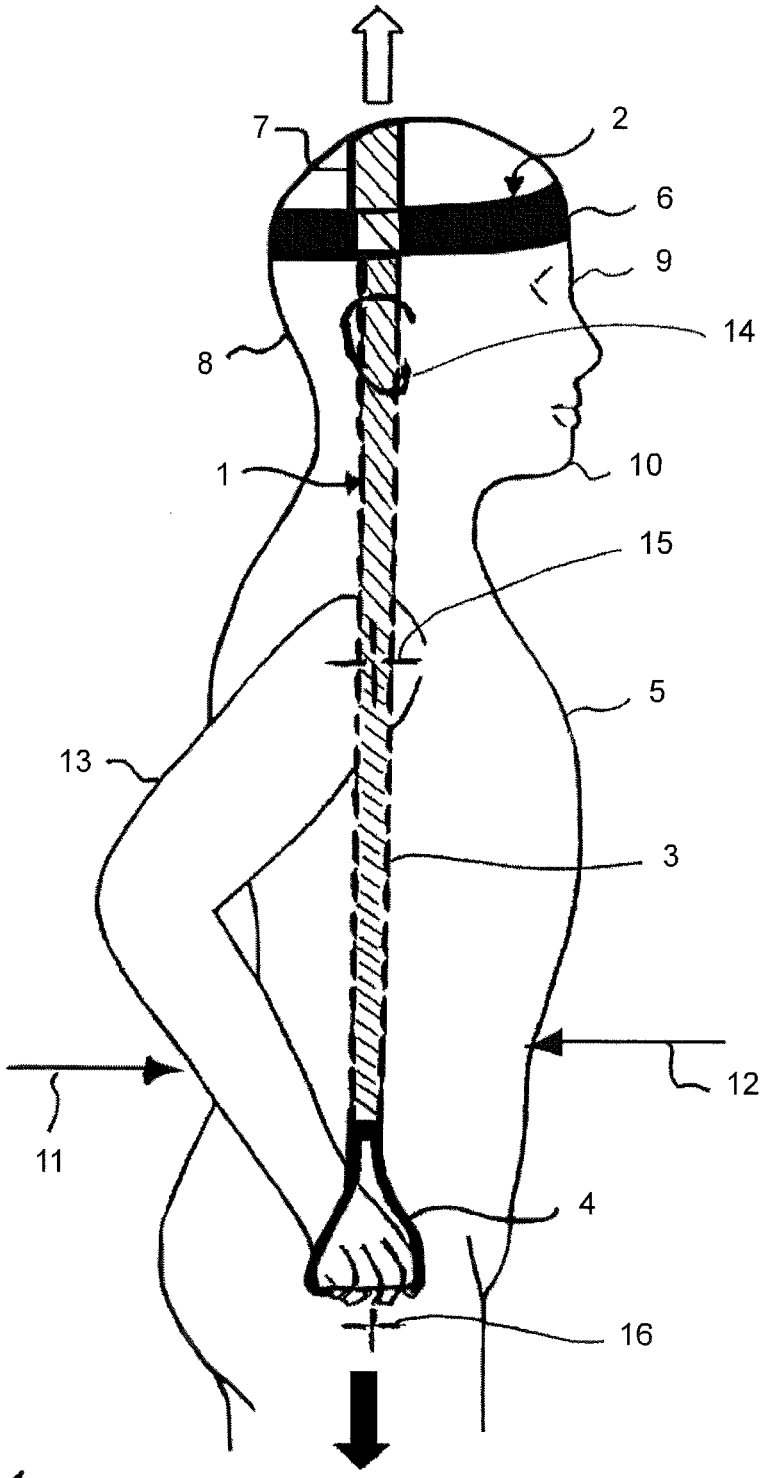
FIG. 1 depicts an exerciser according to the invention in situ with a user shown in outline.

Referring firstly to FIG. 1, there is shown exerciser 1 comprising headpiece 2, strap 3 and handgrip 4. There are a corresponding strap and handgrip on the opposite side of the exerciser, these items being obscured by the user 5 of the exerciser. Headpiece 2 consists of a first member 6 and a second member 7 which extends between opposite sides of first member 6.

Exerciser 1 is configured for use by an adult and as such the flexible straps thereof apply a maximal load of 40 Kg to the neck of a user. The elasticity of strap 3 is thus selected so that a maximum 20 kg is provided. Where the exerciser is for use as a feedback device, only a gentle pressure is required to the crown of the head.

The manner of using exerciser 1 can also be appreciated from FIG. 1. User 5 has fitted headpiece 2 about the user's head 8. While standing with head 8 extended with the face 9 parallel to the coronal plane (so that the chin 10 is "tucked in") and stomach muscles contracted—as generally indicated by arrows 11 and 12—user 5 applies force to headpiece 2 by straightening arm 13 to stretch strap 3. Bending arm 13 with retraction of strap 3 allows the action described in the preceding paragraph to be repeated. (It will be appreciated that the arm on the other side of the body is used to stretch the second strap of the exerciser while bending of that arm allows the second strap to retract.)

It can be seen from FIG. 1 that the ear 14, shoulder joint 15 and hip joint 16 of user 5 should be aligned during the use of exerciser 1 as described in the previous paragraph.

The basic positions in which exercisers of the invention can be used are shown in FIGS. 2 to 10. The exerciser of FIG. 1 is utilized in the FIGS. 2 to 6 and 8 positions.

Figure 2:
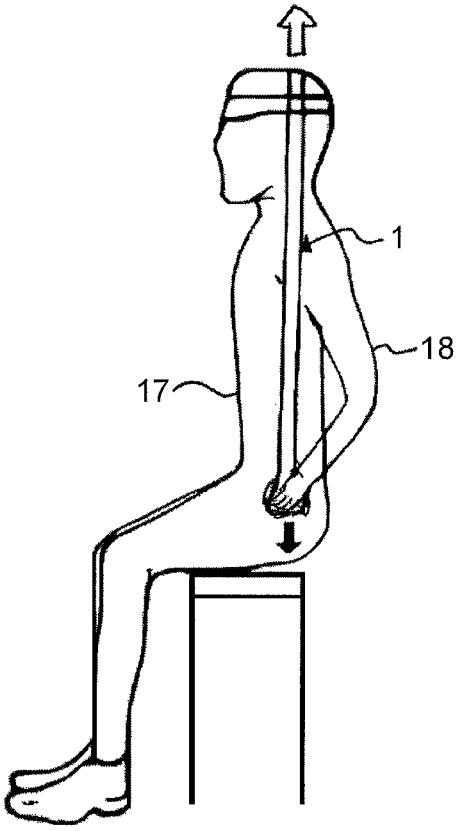
FIGS. 2 to 10 comprise schematic representations of positions in which the exerciser can be utilized.

In FIG. 2 there is shown use of exerciser 1 by a person 17 in a seated position. Straightening arm 15 gives the extension force while the head is extended vertically to give the counter force.

Figure 3:
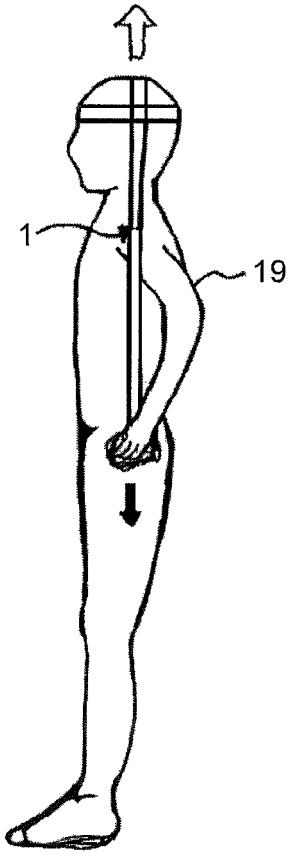

FIG. 3 shows use of exerciser 1 while in a standing position. Once again, Straightening arm 19 gives the extension force while the head is extended vertically to give the counter force.

Figure 4:
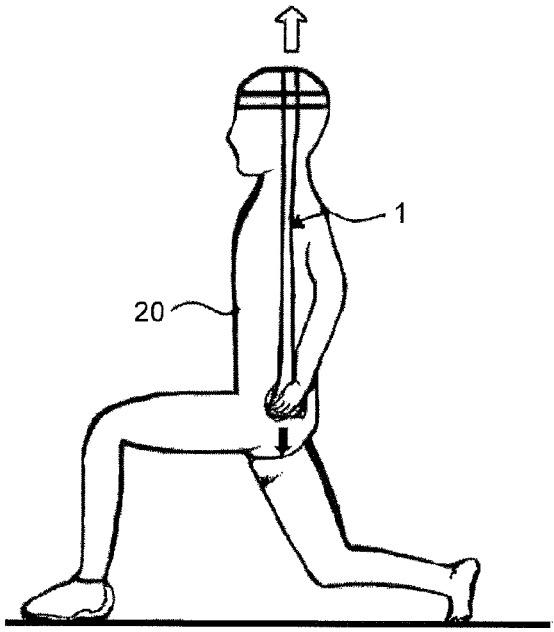

The user 20 of exerciser 1 in FIG. 4 can be seen to be in a lunge position.

Figure 5:
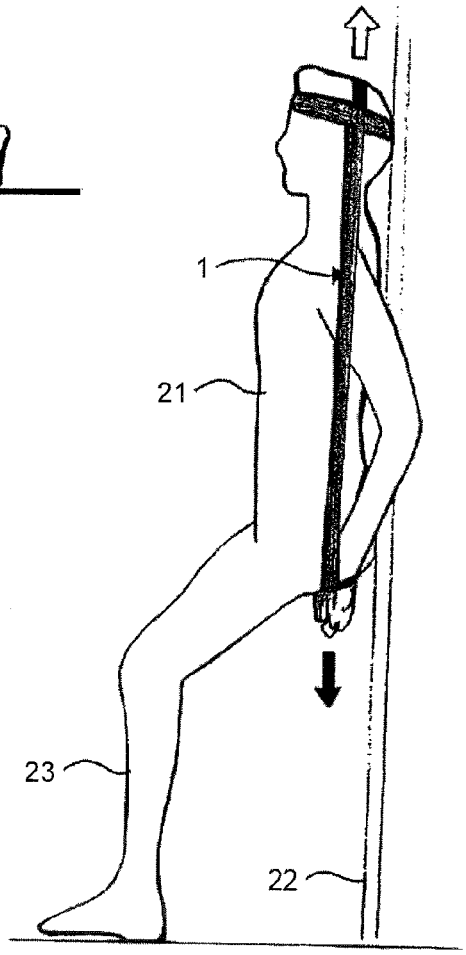

In FIG. 5 there is depicted use of exerciser 1 by a person 21 whose back is against a vertical object such as a pole 22. The legs of the user—one of which legs is item 23—can be bent into a squatting position. The vertical object can be a surface such as a wall. When the object is a wall, the arms of the user need to be abducted so that the elbows clear the wall.

Figure 6:
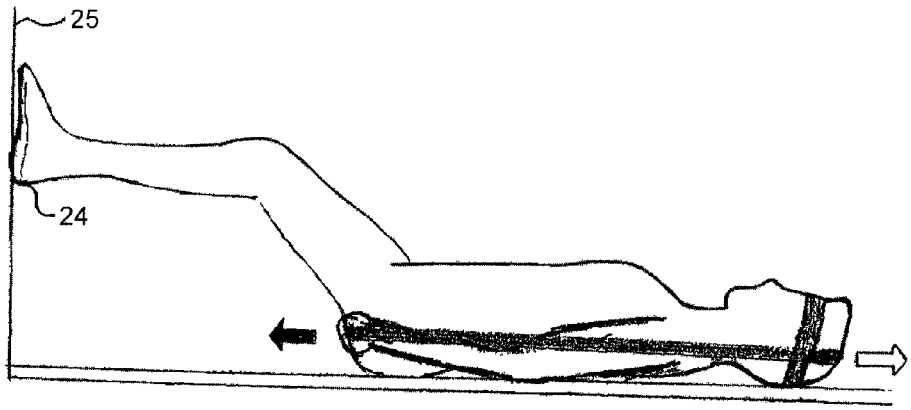

FIG. 6 depicts use of the exerciser while supine. Preferably, the heels of the user—one of which heels is item 24—are applied to a firm surface such as a wall as indicated by vertical line 25. It will be appreciated that such a surface is required to immobilize the user and simulate weight-bearing. The knees and hips can be bent to various angles.

Figure 7:
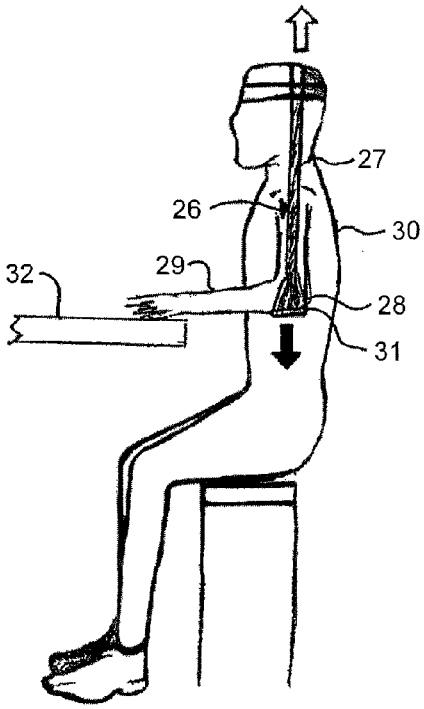

In FIG. 7 there is shown use of an exerciser according to the invention where the straps are stretched by movement of the elbows. In this usage, each strap of exerciser 26—one of which straps is item 27—has a loop 28 at its end through which an arm 29 of the user 30 is passed until the loop is near the elbow 31. This mode of use is particularly suited for the activation of deep posture and antigravity muscles while the user is seated at a desk 32 for example.

Figure 8:
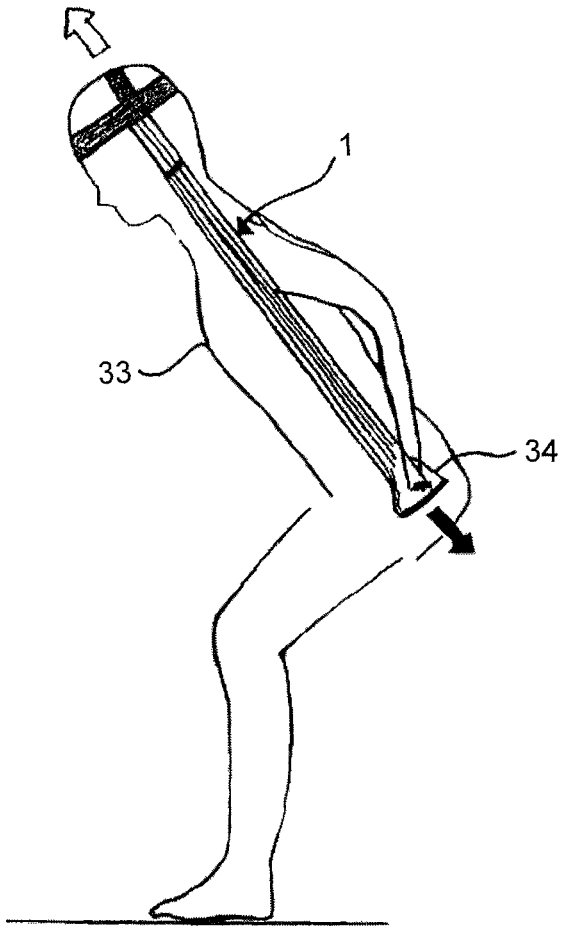

FIG. 8 depicts a trunk forward leaning position and with the user 33 of exerciser 1 bending from the hip joints 34. Even though the spine of the user is not vertical, it can be appreciated from the drawing that spinal alignment is maintained with the hip joint and shoulder joint linearly aligned with the ear (which is in the coronal plane). The knees of the user can be bent, as shown in the drawing, or straight.

Figure 9:
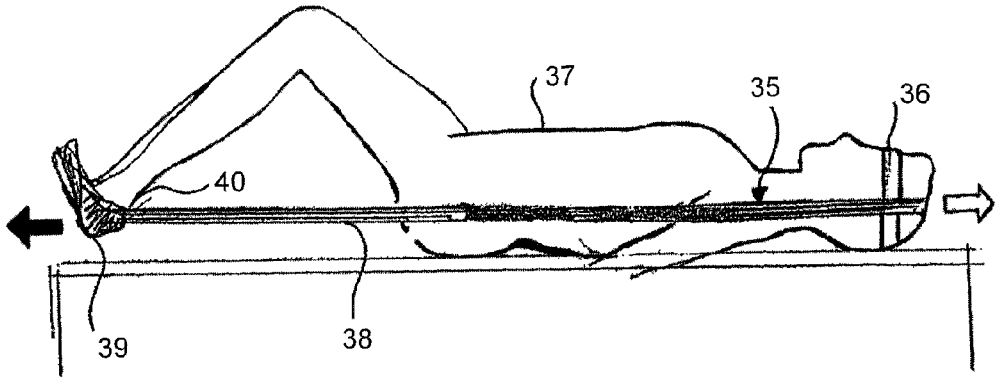

FIG. 9 depicts use of an embodiment of the invention where the straps of the exerciser are stretched by the legs of the user. Unlike the use depicted in FIG. 6, the feet of the user are free to move against the resistance of the straps. Elements of FIG. 9 are exerciser 35 which includes a pair of straps extending from headpiece 36 to the feet of user 37, one of which straps is item 38. Each strap has a cup which receives a heel of user 37. The cup at the end of strap 38 is item 39 which has received heel 40 of user 37.

Figure 10:
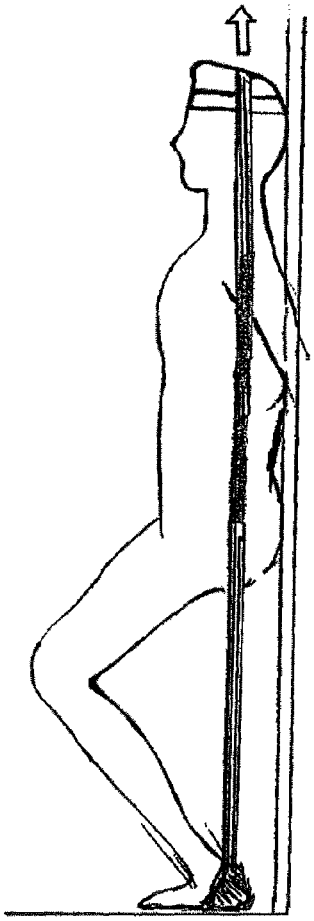

The FIG. 10 use situation is similar to that depicted in FIG. 9 but the strap extension is effected by the upward movement of the whole body by the straightening of the legs.

There is reference above to use of the subject exerciser in a simulated weight-bearing situation in any position. Such a situation is advantageously attained with equipment generally referred to as a "home gym".

Figure 11:
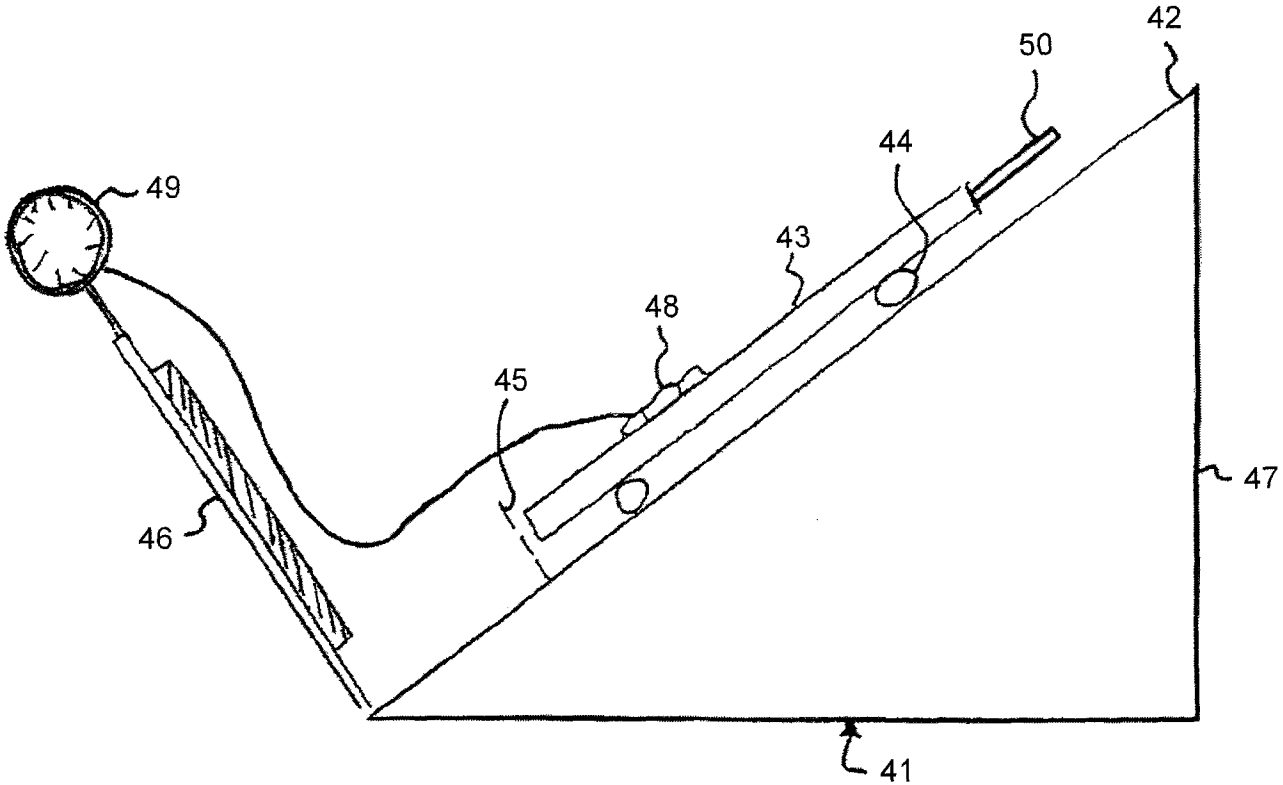
FIG. 11 is schematic representation of equipment which can advantageously be used in conjunction with the exerciser of the invention.

As depicted in FIG. 11, the equipment 41 with which the exerciser can be conveniently used comprises a pair of parallel rails, the angle of which relative to the horizontal can be adjusted. The proximal rail of the pair is item 42 of FIG. 11. A glide board 43 is associated with the rails along which the glide board can move by virtue of wheels on the underside of the board, one of which wheels is item 44. An adjustable stop 45 spans the rails to limit the downward movement of glide board 43. The adjustable stop 45 has up to five different positions which allow for individual difference in user height and length of leg. There is additionally provided a panel 46 spanning the lower ends of the rails and extending upwardly normal to the rails. As will be explained below, the feet of a user of the equipment are placed against panel 46 while lying on the glide board.

Glide board 43 and panel 46 are typically cushioned for the comfort of a user. It will be appreciated from FIG. 11 that at least one vertical member 47 is provided to elevate the upper ends of the rails.

Equipment 41 can further include an air-filled cushion (e.g., a Stabilizer™ pressure biofeedback unit manufactured by Chattanooga Group, Inc. of 4717 Adams Road, Hixson, Tenn. 37343, USA) 48 which is positioned on the glide board at a position which will put the pressure biofeedback unit in contact with the dorsal (low back) region of a user when lying on the equipment. The pressure dial 49 of the pressure biofeedback unit can be mounted to the foot panel 46 so that it is visible by a user of the equipment. (In FIG. 11, dial 49 has been rotated 90° from its in use position for aid of interpretation.)

The resistance to movement of glide board 43 can be increased by adding weights to the board. Fittings can be provided at 50 for receiving weights.

Figure 12:
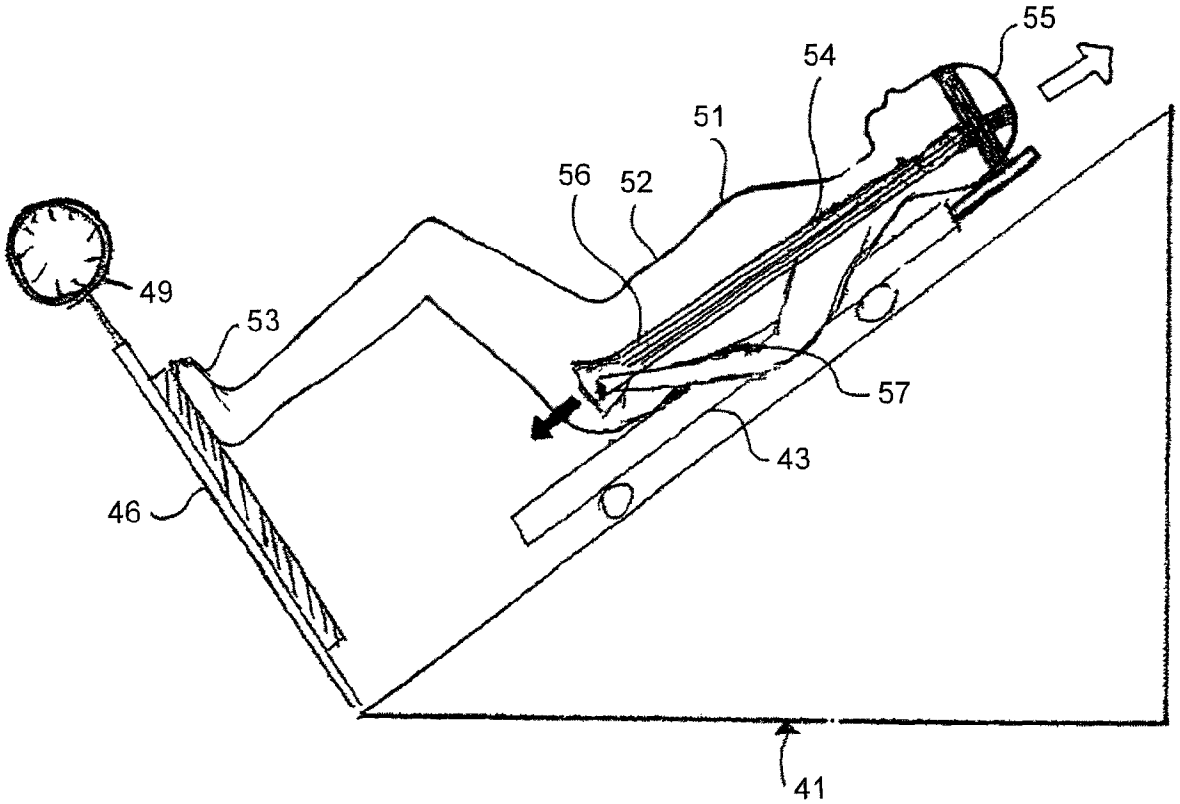
FIG. 12 is a schematic representation of a person using the exerciser according to the invention in combination with equipment depicted in FIG. 9.

The manner of using an exerciser according to the invention in conjunction with equipment 41 is depicted in FIG. 12. In FIG. 12, a user 51 is shown lying on glide board 43 of equipment 41. The trunk 52 of user 51 is generally coincident with the glide board while the feet 53 of the user are pressed against panel 46.

Exerciser 54 can be seen fitted to the head 55 of user 51 with each strap of the exerciser held by the user with arms extended so that the straps apply pressure to the head of the user. One such strap is item 56. The pressure biofeedback unit is positioned under the low back of the user as generally indicated by item 57. For illustrative purposes, dial 49 of pressure biofeedback unit 48 (see FIG. 11) is shown in a position which is easily viewable by user 51.

The use of the exerciser/equipment combination relies on the general principle of producing an axial, joint compressive force through the body to simulate weight-bearing. Simulation of the vertical force of gravity is attained by (i) releasing the adjustable stop 45 to allow the glide board 43 to be free to slide and thus body weight becomes the exercise load; and (ii) using the arms to stretch the straps (item 56 and its companion strap) of exerciser 54 to create a low level downward force, similar to gravity.

The correct exercise training requires exercise to train the antigravity muscle system while maintaining good, safe posture. Leg or legs are placed in a variety of positions against panel 46 so that the antigravity muscles can work as the knees and hips bend slowly and then straighten. At the same time, the individual stretches tall through the back of the crown of the head while getting feedback from exerciser 54. This total body "antigravity" exercise is completed with the pressure dial 49 giving feedback that good posture has been maintained, ensuring that "core stability" has not been lost during the total body "antigravity" exercise.

The glide board of the equipment can comprise a grid so that the position of the lower limbs (the feet in particular) can be determined relative to the center of gravity. The glide board can also include devices for providing sensory input such as a vibrator. These adaptations are desirable to assess exercise progression, particularly when the exerciser/equipment combination is being used for rehabilitation.

In variations of the use shown in FIG. 12, the straps of the exerciser can be shortened for extension by the elbows (see FIG. 7), or can be lengthened for a similar use as shown in FIG. 10.

Figure 13:
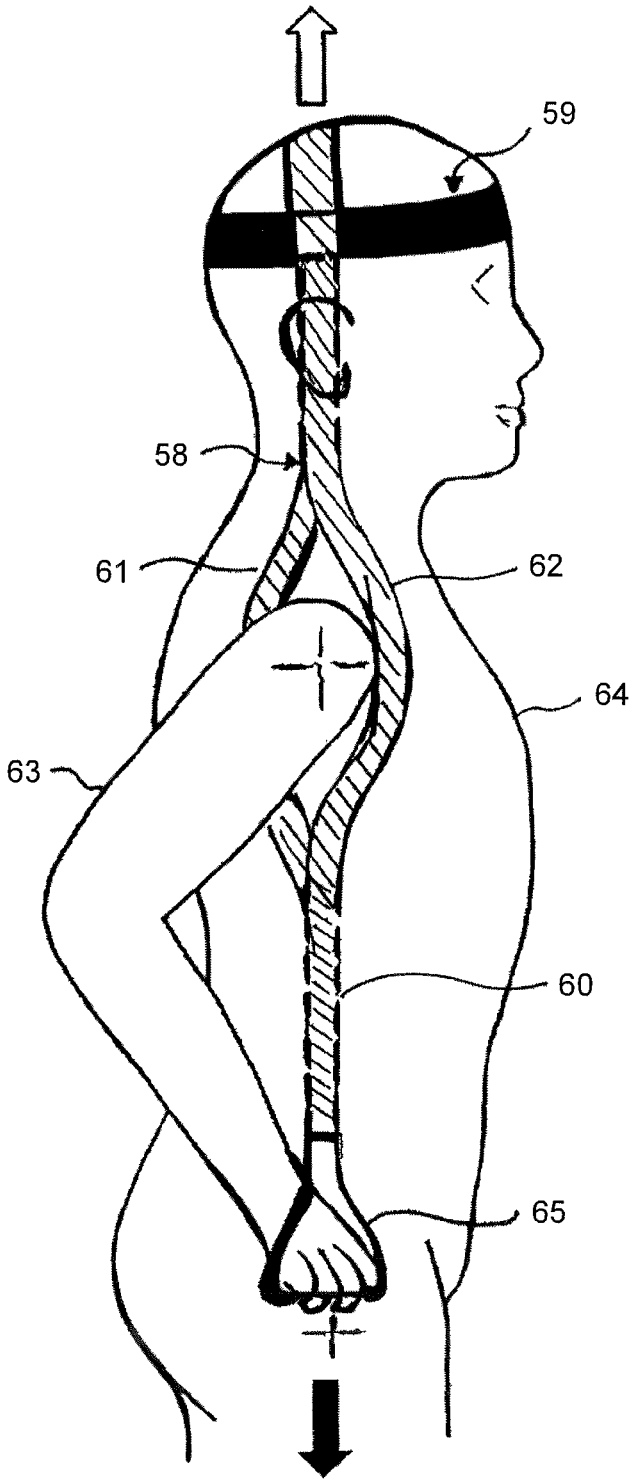
FIGS. 13 and 14 depict exercisers according to the invention, again in situ, but which have different straps to the exerciser shown in FIG. 1.
Figure 14:
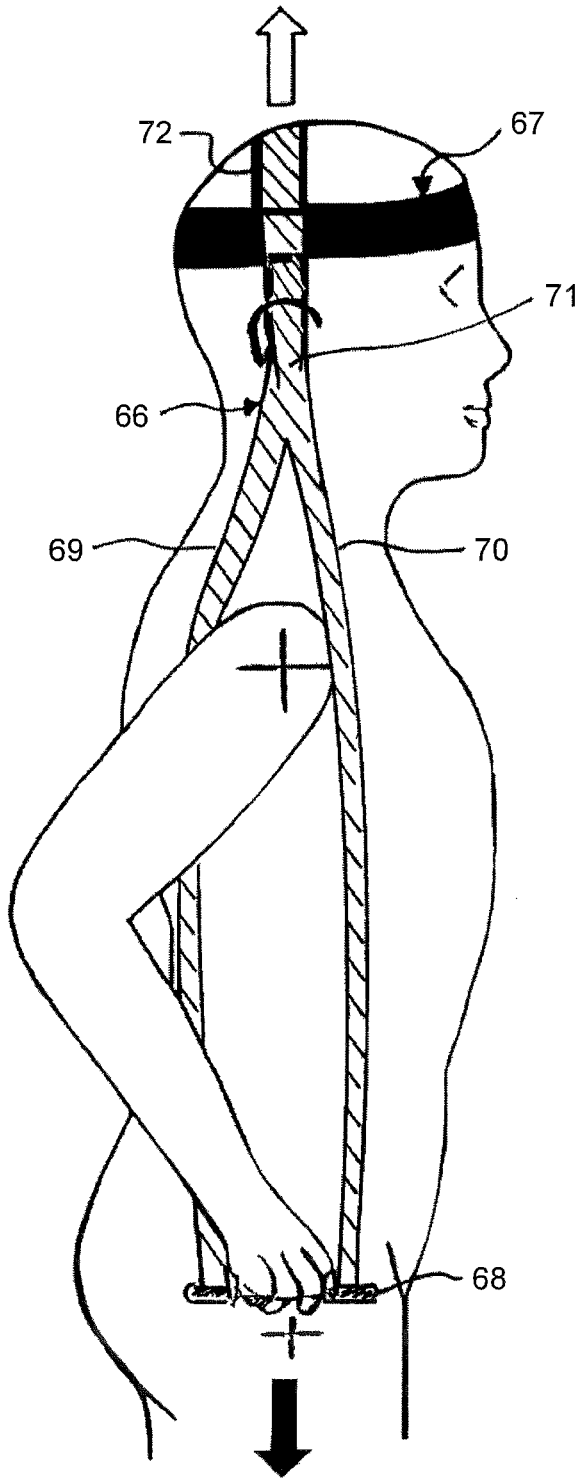

Preferred embodiments of the exerciser of the invention are shown in FIGS. 13 and 14. Like the exerciser depicted in FIG. 1, exerciser 58 of FIG. 13 comprises a headpiece 59. However, rather than having a strap that comprises a single strip of material, strap 60 of exerciser 58 divides into two portions 61 and 62 through which arm 63 of user 64 is passed. The free end of strap 60 has a handgrip 65 fitted thereto. There are a corresponding strap and handgrip on the opposite side of the exerciser, these items again being obscured by the user 64 of the exerciser.

That variant exerciser 66 depicted in FIG. 14 similarly has a headpiece 67 and a handgrip 68. Rather than having a single strap, exerciser 66, on each side thereof, has two straps. The straps on the side of the exerciser visible in the drawing are items 69 and 70 (the straps on the other side of the exerciser being obscured by the user). These straps extend from a common point of attachment 71 on second member 72 of headpiece 67 to opposite ends of handgrip 68. Straps 69 and 70 can be a single piece of folded material or can comprise two separate pieces of material.

Save for any inelastic material needed at the ends of straps for attachment to other components of the exercisers, the straps of exercisers 59 and 66 comprise elastic material throughout their entire lengths.

Exercisers 59 and 66 are ideally suited for use in the second embodiment method defined above, including that embodiment as exemplified in FIGS. 2 to 12. An advantage of these preferred exercisers is that the user can more easily align his or her ear, shoulder joint, and hip joint in accordance with the use of an exerciser as depicted in FIG. 1.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

The invention claimed is:

1. An exerciser comprising:

a headpiece having at least:

a first member which fits around the head of a wearer in a transverse plane above the ears when said headpiece is in situ; and a second member which is fixed to said first member at or near the ends of said second member and which crosses the head of said wearer at about the coronal plane thereof when said headpiece is in situ;

two flexible straps of equal length on each side of said headpiece which are attached to said second member and wherein at least one portion of the total length of each flexible strap is elastic; and free ends of said two flexible straps on each side of said headpiece are each connected to an adaptation for permitting extension of the straps by a limb of said wearer, and wherein one of said two flexible straps extends around the front of the shoulder of a wearer and the other of a said two flexible straps extends around the back of the shoulder of a wearer, when said exerciser is in situ;

wherein, each of said two flexible straps has a length and elasticity which allow a smooth, low velocity movement by said wearer at least involving axial movement of said limb away from the head to provide an axial compressive downward force from the top of the head for exercising the anti-gravity muscles of the wearer.

2. The exerciser of claim 1, wherein said first and second members of said headpiece are length-adjustable.

3. The exerciser of claim 2, wherein said first member has length adjustment devices at the front and rear of said headpiece.

4. The exerciser of claim 1, wherein said headpiece is selected from the group consisting of a cap, hat or helmet.

5. The exerciser of claim 1, wherein each of said two flexible straps comprises a rubberized strip of material.

6. The exerciser of claim 1, wherein each of said two flexible straps comprises at least one metal coil spring.

7. The exerciser of claim 1, wherein the elasticity of each of said two flexible straps is variable.

8. The exerciser of claim 1, wherein each said flexible straps of equal length on each side of said headpiece is length-adjustable.

9. The exerciser of claim 1, wherein the adaptation at the free end of each said two flexible straps of equal length on each side of said headpiece is selected from a loop, a hand grip, a cup or a socket.

10. The exerciser of claim 1, wherein said two flexible straps of equal length on each side of said headpiece form continuous straps over the head when said headpiece is in situ.

11. A method of training neuromuscular control of a chain of muscles involved in holding good posture, through the activation of deep posture and antigravity muscles, the method comprising the steps of:

(a) fitting a headpiece of an exerciser according to claim 1;

(b) applying a limb to at least one of the adaptations of said exerciser;

(c) extending each strap by limb movement associated with depression and holding of the scapula, with the hip joint and shoulder joint in axial alignment with the ear in the coronal plane;

(d) holding each strap extended for at least five seconds;

(e) relaxing the limbs and shoulders to allow each strap to retract; and (f) repeating steps (c) to (e) until said deep posture and antigravity muscles are sufficiently activated.

12. The method of claim 11, wherein in step (d) each said strap is held extended for up to two minutes.

13. The method of claim 11, wherein steps (b) to (f) are conducted with a user in a position selected from the group consisting of sitting upright, standing upright, kneeling, or supine.

14. The method of claim 11, wherein steps (b) to (f) are conducted with a user supine adjacent a vertical surface to which the legs of the user can be applied to immobilize the user.

* * * * *